United States Patent [19]

Enoksen

[11] 4,041,431

[45] Aug. 9, 1977

[54] INPUT LINE VOLTAGE COMPENSATING TRANSFORMER POWER REGULATOR

[75] Inventor: Gerald E. Enoksen, Karlstad, Minn.

[73] Assignee: Ralph Ogden, Munster, Ind.

[21] Appl. No.: 743,768

[22] Filed: Nov. 22, 1976

[51] Int. Cl.[2] ..... H01F 21/08; G05F 1/32

[52] U.S. Cl. ..... 336/160; 29/602 R; 323/45; 323/56; 336/184; 336/215

[58] Field of Search ..... 323/44 R, 45, 56; 336/155, 184, 214, 215, 170; 29/602, 605

[56] References Cited

U.S. PATENT DOCUMENTS 2,306,578 12/1942 Wetzel ..... 323/56 X

*Primary Examiner*—Thomas J. Kozma
*Attorney, Agent, or Firm*—McWilliams & Mann

[57] ABSTRACT

A transformer power regulator and method of utilizing same for efficiently and variably delivering A.C. power to a load by regulating only a portion of the input voltage equal to maximum expected voltage variation in the input voltage source while transmitting most of the power directly to the load through some of the transformer windings. The laminated core structure is continuous and uninterrupted including primary and secondary winding leg portions and back portions defining a main magnetic flux circuit. A pair of control winding leg portions, with bridging portions therebetween define a separate control magnetic flux circuit. Variable energization of a pair of control windings, one on each of the control winding leg portions, variably controls the magnetic reluctance of the control magnetic flux circuit. A primary winding on the primary winding leg portion is connectible to an A.C. voltage source. Most of the power to the load is transmitted through the series combination of a bucking winding on the primary winding leg portion and a secondary winding on the secondary winding leg portion resulting in high power transmission efficiency between the source and the load. The bucking winding inductively drops a portion of the input voltage thereacross to compensate for the maximum expected deviation of the voltage source from its nominal value. Selective energization of the control windings provide control of the reluctance of the control winding leg portions, thereby controlling the shunting of flux induced in the primary winding leg portion away from the secondary winding leg portion. The secondary winding adds a variable voltage to return the voltage at the load to the desired nominal value despite deviations in the voltage source.

7 Claims, 5 Drawing Figures

INPUT LINE VOLTAGE COMPENSATING TRANSFORMER POWER REGULATOR

BACKGROUND OF THE INVENTION

This invention relates in general to transformer voltage regulators which transmit a significant amount of power from an input voltage source to a load, and more particularly to a transformer regulator which transmits most of the power through some of the transformer windings directly to the load and which regulates only that portion of the voltage which corresponds to the maximum expected deviation of the input voltage control means such that the voltage at the load remains at the desired nominal value despite deviations in the input voltage source.

A.C. voltage sources are ideally designed to supply constant voltage independent of the current load demanded. However, due to a number of factors including physical line resistance, load demanded by other apparatus, control of the A.C. power generating equipment, and various other factors, the A.C. voltage available from a voltage source frequently deviates, either positively or negatively, from the desired nominal value. Not infrequently, this deviation can exceed 10 per cent. Many applications exist where such deviation is not acceptable. Often times in such situations, the user must resort to generating his own highly regulated A.C. power rather than using that commercially available from electrical generating utilities.

Many types of transformers are known to the prior art. However, transformers are inherently poor voltage regulators because the output voltage of a transformer is proportionately related to the input voltage applied to the transformer by the turns ratio of the various transformer windings. Thus, any deviation in the input voltage applied to the transformer results in a corresponding proportional deviation in the output voltage of the transformer. That is, conventional transformers proportionately pass any deviation in the input directly to the output. It is therefore typical to concentrate on regulating the output supplied by the transformer by means of a separate voltage regulator interposed between the transformer and the load. While this approach is suitable for low D.C. voltage levels, suitable semiconductors for higher A.C. voltage levels are still quite expensive. Furthermore, the switching characteristics of semiconductors introduces wave form distortion and noise when attempting to reproduce the usual sine wave form typical of A.C. power generation. This necessitates bulky and expensive filtering.

Prior art transformers also suffer from undesirable size and weight disadvantages when 2000 watts or more of power are transmitted. Such transformers also become quite expensive because of the volume of material required to fabricate larger transformers.

SUMMARY OF THE INVENTION

The present transformer regulator invention utilizes a special laminated core structure to achieve a nearly infinite degree of magnetic flux coupling between the primary and secondary windings of the transformer. The main magnetic flux circuit, including a primary leg portion, a secondary leg portion and back portions interconnecting the primary and secondary leg portions, is of preferably uniform cross-sectional area. The main magnetic flux circuit is further of a closed circuit configuration and is continuous and uninterrupted, as by air gaps or the like. A separate control magnetic flux circuit is interposed intermediate the primary and secondary winding leg portions therebetween providing a continuous and uninterrupted control flux circuit configuration. Separation of the main magnetic flux circuit from the control magnetic flux circuit eliminates wave form distortion in the output power of the transformer. For best weight, volume and power transmission efficiencies, the cross-sectional area of the winding leg portion is 50 per cent of that of the primary or secondary winding leg portion. With such a core structure, the control winding leg portions are able to shunt any magnetic flux introduced in the primary winding leg portion away from the secondary winding leg portion, or any selectable portion thereof as will be hereinafter appreciated.

Novel features of the present invention are the winding arrangements and interconnections which enable the transformer regulator to directly transmit to a load the majority of power demanded thereby, while regulating only that portion of the load necessary to compensate for deviations in the A.C. voltage supply. A primary winding has a plurality of turns wound about the primary leg portion of the core and includes first and second leads for application of the A.C. voltage source thereacross. A bucking winding with a plurality of turns is also wound about said primary winding leg portion, with a first lead of same connected to one of the leads of the primary winding. The bucking winding consists of fewer turns than the primary winding and is phased to drop a portion of the A.C. voltage source. A secondary winding consisting of a plurality of turns is wound about the secondary winding leg portion. A first lead of the secondary winding is connected to the second lead of the bucking winding such that the bucking and secondary windings are in series connection between the A.C. voltage source and the load. However, the secondary winding is phased to add any variable voltage induced thereacross by the controllable coupling between the primary and secondary windings to achieve in a highly regulated A.C. voltage at the load.

Control windings on each of the control winding leg portions are phased in bucking relationship to the main magnetic flux circuit, but in aiding relationship with respect to the control magnetic flux circuit for application of equal ampere turns to the control winding leg portions. The control windings are energizable between deenergized and fully energized conditions to correspondingly vary the reluctance of the control winding leg portions between minimum and maximum conditions such that the control winding leg portions variably shunt flux from the main magnetic flux circuit induced in the primary leg portion away from the secondary winding leg portion in inverse proportion to the magnetic reluctance of the control winding leg portions.

Because the transformer regulator regulates only that portion of the power transmitted necessary to compensate for expected deviation in the A.C. voltage source, a transformer of relatively low power rating is capable of controlling and regulating a much higher amount of power to a load. The relationship between the amount of power regulated and the total amount of power transmitted depends upon the amount of deviation in the D.C. voltage source. Under the teachings of the present invention, the transformer regulator in typical applications is capable of controlling voltage at the load while transmitting at least six times the power rating of the transformer employed under typical A.C. voltage source deviations.

Various other objects, features and advantages of the invention will become apparent from the following detailed disclosure when taken in conjunction with the drawings.

DESCRIPTION OF THE PEFERRED EMBODIMENTS

Figure 1:
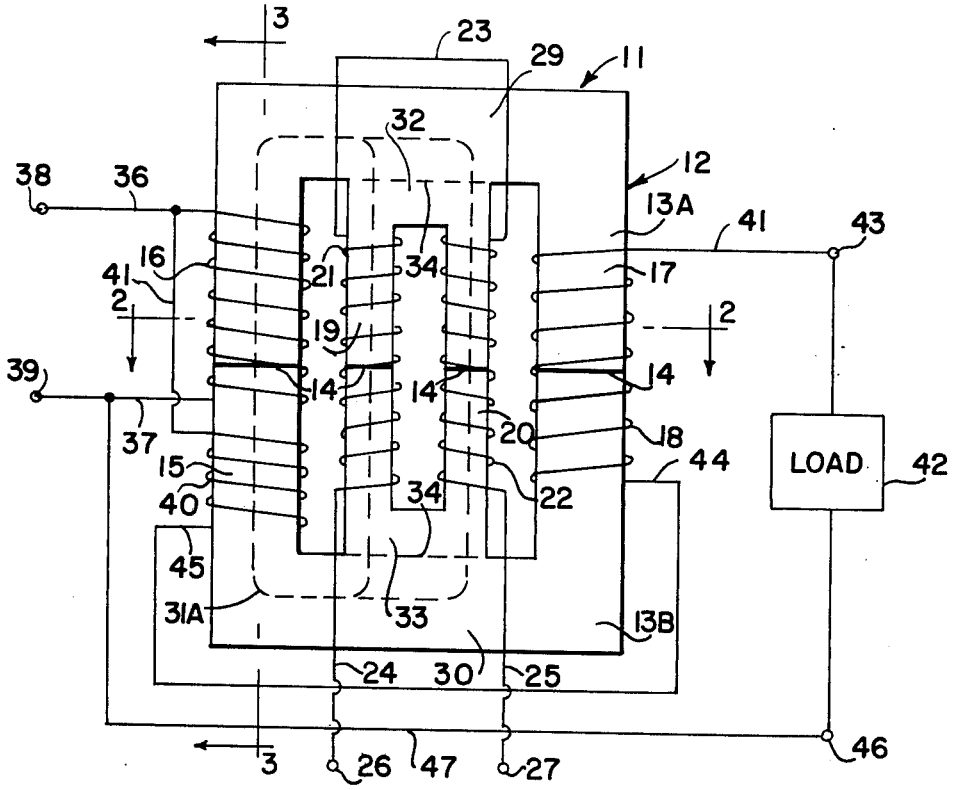
FIG. 1 is a diagrammatic plan view illustrating one embodiment of the invention with the output of the transformer connected to a load, and further illustrating the shunting of A.C. magnetic flux through the control winding leg portions when the control windings are deenergized.
Figure 4:
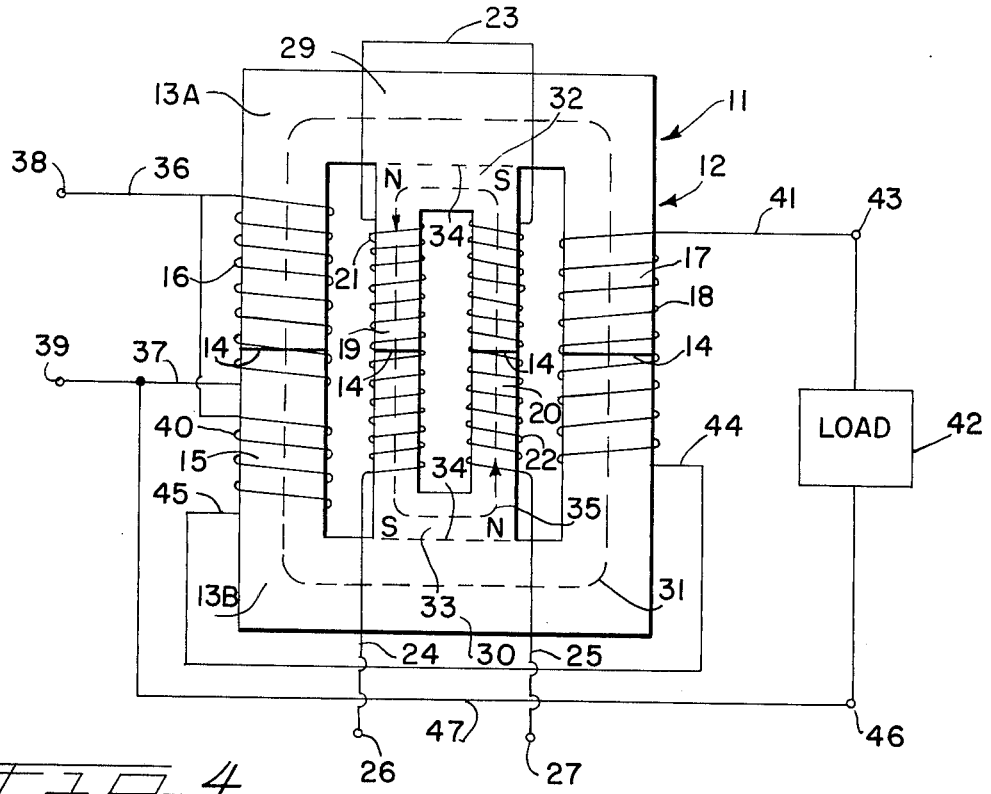
FIG. 4 is similar to FIG. 1, but illustrating respectively the main magnetic flux circuit path between the primary and secondary windings and the control magnetic flux path through the control windings when the control windings are fully energized.

Reference numeral 11 in FIGS. 1 and 4 generally designates one embodiment of the transformer power regulator of the instant invention. The transformer regulator comprises a core structure 12 and a winding arrangement and interconnection of the core structure 12 which will be hereinafter more fully described.

According to the invention, the core structure 12 is of critical importance in obtaining the results and advantages of the transformer power regulator 11, as will become apparent. The core structure 12 utilizes a pair of generally "E" - shaped laminated core bodies or sections 13A, 13B. The core sections 13A, 13B are preferably paired as indicated above, which facilitates ease of winding or inserting and mounting prewound windings upon the various legs of the sections 13A, 13B. However, it should be readily apparent to those skilled in the art that the core structure 12 could instead be a single section equivalent to the pair of "E" sections 13A, 13B when assembled in abutting relationship as shown in the drawings.

Returning to FIG. 1, it is seen that the core sections 13A, 13B are oriented and joined together such that the various legs of each of the sections 13A, 13B are in abutting relationship with a similar legs of the opposite section, as at 14. It is extremely important that the various legs of the sections 13A, 13B actually contact each other to avoid any air gaps therebetween. Any air gaps between the legs of the sections 13A, 13B will cause discontinuities in the magnetic flux circuits, as hereinafter described, thereby greatly reducing the operational ability of the transformer power regulator 11.

Any suitable means of holding the sections 13A, 13B in close abutting relationship may be employed. Examples known to those skilled in the art include various frame structures, banding or strapping techniques, bonding or potting methods, and others.

When the core sections 13A, 13B are assembled in abutting relation, a primary winding leg portion 15 is provided for mounting a primary winding 16 thereon. Likewise, a secondary winding 18 is mounted on a secondary winding leg portion 17. A pair of control winding leg portions 19, 20 respectively have mounted thereon control windings 21, 22.

The control windings 21, 22 are connected in a phasing relationship which cancels out any electromotive forces induced in same by the action of the transformer primary or secondary windings 16, 18. The windings 21, 22 preferably have the same number of turns and are connected in series to insure that each winding 21, 22 introduces equal ampere turns into the respective leg portions 19, 20. The phasing relationship between the control windings 21, 22 described above and diagrammatically illustrated in the drawings causes the flux induced in each control winding leg portion 19, 20 by the corresponding control winding 21, 22 to be additive — contrary to the effects of flux from the primary and secondary windings 16, 18. However, other windings relationships and even parallel connections between the control windings 21, 22 are possible if care is taken to insure that each control winding leg portion 19, 20 receives equal ampere turns. Leads 24, 25 from the respective control windings 19, 20 have terminals or ends 26, 27 for connection to a suitable control means (not illustrated).

Figure 3:
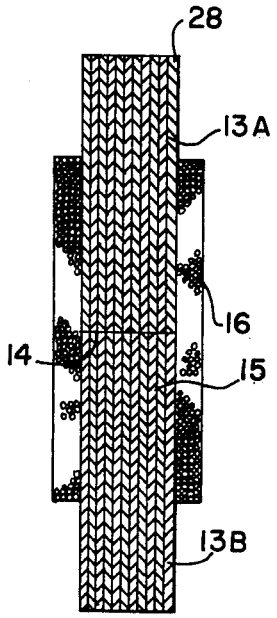
FIG. 3 is a diagrammatic cross-sectional view taken substantially along the cross-sectional line 3—3 in FIG. 1.

Returning to further consideration of the core structure 12, the core structure 12 consists of a plurality of sheets 28 (FIG. 3) of suitable transformer steel or iron or the like suitably laminated together by employing an appropriate bonding substance according to known transformer core fabrication techniques. One important aspect of the invention is that the core structure 12 provides a separate main magnetic flux circuit and a separate control magnetic flux circuit when the control magnetic flux circuit is fully energized as diagrammatically illustrated in FIG. 4. Dashed line 31 in FIG. 4 indicates a typical flux path in the main magnetic flux circuit when the control windings 21, 22 are fully energized. Dashed line 35 indicates a typical flux path in the control magnetic flux circuit. When the control windings 21, 22 are deenergized, dashed line 31A in FIG. 1 illustrates the shunting path of magnetic flux by the control winding leg portions 19, 20 from the primary winding leg portion 15 away from the secondary winding leg portion 17. Separation of the flux circuits is necessary to avoid wave form distortion of the normal sine wave of output of the transformer regulator 11 during partial or full energization of the control windings 20, 21.

An upper back portion 29 and a lower back portion 30 are located intermediate the ends of the primary winding leg portion 15 and the secondary winding leg portion 17. The combination of the portions 15, 17, 29, 30 defines a main magnetic flux circuit between the primary winding 16 and the secondary winding 18 with said flux circuit being substantially continuous and uninterrupted, as by air gaps or the like. The transverse cross-sectional area of the various portions 15, 17, 29, 30 are preferably equal for best volume and weight efficiencies. The actual cross-sectional areas depend upon the desired power transmitting capability of the transformer regulator 11, as is well known to those skilled in the art.

The control magnetic flux circuit is preferably located within the main magnetic flux circuit for variably shunting flux induced in the primary winding leg portion 15 by the primary winding 16 away from the secondary winding leg portion 17. The control magnetic flux circuit thus controls the degree of magnetic flux coupling between the primary winding 16 and the secondary winding 18. FIG. 1 illustrates one extreme condition wherein the control windings 21, 22 are deenergized and the control magnetic flux circuit shunts all of the magnetic flux induced in the primary winding leg portion 15 away from the secondary winding leg portion 17, as by the path 31A.

FIG. 4 illustrates the opposite extremes wherein the control windings 21, 22 are fully energized thereby magnetically saturating the control winding leg portions 19, 20 such that none of the magnetic flux induced in the primary winding leg portions 15 is shunted by the control winding leg portions 19, 20. The result is a high degree of magnetic coupling between the primary winding 16 and the secondary winding 18. Various degrees of magnetic coupling between the primary winding 16 and the secondary winding 18 can be achieved by varying the magnetic reluctance of the control winding leg portions 19, 20 which is in turn directly related to the degree of energization of the control windings 21, 22. The amount of magnetic flux shunted from the main magnetic flux circuit is inversely proportional to the reluctance of the control winding leg portions 19, 20.

The control magnetic flux circuit is also continuous and uninterrupted. A pair of bridge portions 32, 33 between the ends of the control winding leg portions 19, 20 define the control magnetic flux circuit. The transverse cross-sectional area of the bridge portions 32, 33 must be at least equal to or greater than the transverse cross-sectional area of the control winding leg portions 19, 20. The bridge portions 32, 33 are separated from the back portions 29, 30 by dashed lines 34 for each of understanding and illustration. However, it is to be understood that the bridge portions 32, 33 are an integral part of each lamination of the core structure 12. The transverse cross-sectional areas of same that are referred to are sections taken normally of the respective line 34. If the transverse cross-sectional areas of the bridge portions 32, 33 are less than those of the leg portions 19, 20 some control flux will necessarily pass in the back portions 29, 30 of the main flux circuit when the control windings 21, 22 are fully energized. Such interference of the control magnetic circuit with the main magnetic flux circuit results in distortion of the A.C. sine wave output of the secondary winding 18 and is therefore undesirable.

Figure 2:
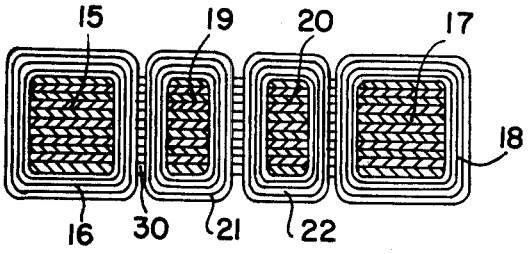
FIG. 2 is a diagrammatic cross-sectional view of the transformer taken substantially along the sectional line 2—2 in FIG. 1.

Another important relationship in the core structure 12 is that the transverse cross-sectional area of the control winding leg portions 19, 20 should each be 50 percent of the transverse cross-sectional area of the primary winding leg portion 15 and the secondary winding leg portion 17. The transverse cross-sectional area of the primary and secondary winding leg portions 15, 17 are equal. FIG. 2 illustrates this relationship between the cross-sectional areas and the further appreciation of this relationship can be gained from FIGS. 1, 4 and 5. Such a relationship between the cross-sectional areas of the various portions provides a full on to full off range of magnetic coupling between the primary winding 16 and the secondary winding 18. However, where a narrow range of control is desired, the indicated cross-sectional areas of the control leg portions 19, 20 maybe as low as 5 per cent as the corresponding cross-sectional areas of the primary and secondary leg portions 15, 17 which will provide a control range of 90 – 100 percent of the full on condition, i.e. there will only be 10 percent turndown available. The cross-sectional area for the control winding leg portions 19, 20 in excess of 50 per cent of the leg portions 19, 20 result in volume and weight inefficiencies and further require greatly increased ampere turns associated with the portions 19, 20 to control the degree of coupling between the primary and secondary windings 16, 18.

At this point it should be appreciated that the range of turndown, i.e. the ratio of maximum power deliverable by the secondary winding 18 to the power actually delivered by the secondary winding 18 under the infinitely variable control means, relates only to the interaction between the primary and secondary windings 16, 18. Since the regulator 11 regulates only that portion of the load power necessary to compensate for input voltage deviations, while transmitting most of the power directly to the load through a series combination of a bucking winding 40 and the secondary winding 18, the range of turndown when viewed in an overall context is more limited. That is, although the range of turndown between the primary and secondary windings 16, 18 is very high, the amount of power being controlled is small in comparison to the power delivered to the load such that the turndown range in a system context is more limited. However, a high range of turndown between the primary and secondary windings 16, 18 is essential to the invention, otherwise correspondingly larger amounts of power must be controlled to compensate for input voltage deviations.

The transverse cross-sectional areas of the bridge portions 32, 33 must be at least equal to the corresponding cross-sectional areas of the control winding leg portions 19, 20. Similarly the transverse cross-sectional areas of the back portions 29, 30 must be equal to or exceed the corresponding transverse cross-sectional areas of the primary and secondary winding leg portions 15, 17.

The following table is the approximate control range between the primary winding 16 and the secondary winding 18 provided for the transverse cross-sectional area of the control winding leg portions 19, 20 as a percentage of the primary and secondary winding leg portions 15, 17 for the transformer power regulator of the invention:

| Control Leg Area | Control Range |
|---|---|
| 5 % | 90 – 100% |
| 10% | 80 – 100% |
| 20% | 60 – 100% |
| 25% | 50 – 100% |
| 30% | 40 – 100% |
| 40% | 20 – 100% |
| 50% | 0 – 100% |

Reference have previously been made to various energization states of the control windings 21, 22. Either A.C. or D.C. current may be impressed across the terminals 26, 27 of the windings 21, 22 to control the reluctance of the control winding leg portions 19, 20. However, if A.C. current is used, the signal impressed across the terminals 26, 27 must be in phase with the A.C. voltage source impressed across the primary winding 16. The control windings 21, 22 are preferably equal in the number of turns and are phased such that, the magnetic flux induced by each of the windings 21, 22 in the control magnetic flux circuit is additive. However, the effects of any magnetic flux from the main magnetic flux circuit induced by the primary winding 16 results in oppositely phased voltages on the windings 21, 22 with said oppositely phased voltages cancelling each other. Thus the main magnetic flux circuit is unable to influence regulation of control magnetic flux circuit.

Many types of variable control for the control magnetic flux circuit will be readily apparent to those skilled in the art. Such control may be either the open loop type or the closed loop type. A simple example of an open loop type of control is the series connection of a battery and a rheostat across the terminals 26, 27. Closed loop control would typically include a means of sensing the output power or voltage of the transformer power regulator and automatically changing the amount of current in the control windings 21, 22 to maintain the output of the regulator at its nominal value. The sensing means for closed loop control may be any of many types, including speed control sensors such as tachometers, thermal controls such as thermocouples, voltage threshold sensitive devices such as zener diodes, or appropriately biased transistors and others. The means for converting a signal from the sensing means to an appropriate current level for the control windings 21, 22 would typically comprise a negative feedback amplifier circuit, the output of which controls the ampere turns in the control winding leg portions 19, 20. The control windings, 21, 22, are energizable between deenergized and fully energized conditions to correspondingly vary the reluctance of the control winding leg portions 19, 20, between minimum and maximum conditions such that the control winding leg portions 19, 20 variably shunt flux from the main magnetic flux circuit induced in the primary winding leg portion 15 away from the secondary winding leg portion 17 in inverse proportion to the reluctance of the control winding leg portions 19, 20.

Because the transformer regulator 11 regulates only that portion of the power transmitted necessary to compensate for expected deviation in the A.C. voltage source, a transformer of relatively low power rating is capable of controlling and regulating a much higher amount of power to a load. The relationship between the amount of regulated and the total amount of power transmitted depends upon the amount of deviation in the A.C. voltage source. Under the teachings of the present invention, the transformer regulator is capable of controlling voltage at the load in a highly regulated manner while transmitted at least six times the nominal power rating of the transformer employed in typical applications.

Of particular importance to the present invention is the arrangement and interaction of the various windings. The primary winding 16 consists of a plurality of turns mounted on the primary winding leg portion 15. A pair of leads 36, 37 connect the primary winding 18 to the A.C. voltage source present at the terminals 38, 39. A bucking winding 40 is also mounted on the primary winding leg portion 15 with a first lead thereof 41 connected to the lead 36 side of the primary winding 16 and hence to the A.C. voltage source present at terminal 38. The bucking winding 40 consists of fewer turns than the primary winding 16 and is phased in bucking relationship with the primary winding 16 to drop a fraction to the A.C. voltage thereacross. Because both the primary winding 16 and the bucking winding 40 are mounted on the primary winding leg portion 15, the magnetic coupling therebetween is nearly perfect and the voltage dropped by the bucking winding turns ratio of the bucking winding 40 the the primary winding 16.

The secondary winding 18 consists of a plurality of turns mounted on the secondary winding leg portion 17. The secondary winding 18 has a first lead 41 connectible to a load 42, as at the terminal 43. A second lead 44 of the secondary winding is connected to a second lead 45 of the bucking winding 40. The secondary winding 18 is further phased in aiding relationship with respect to the primary winding 16. The other terminal 39 of the input A.C. voltage source is connected directly to a second load terminal 46 by a line 47.

One of the principal advantages of the present invention is that the transformer power regulator 11 regulates only that percentage of the power necessary to compensate for maximum expected voltage deviation in the A.C. voltage source. This enables a transformer regulator of a fixed power rating to effectively regulate several times the power of its rating in typical applications because a large percentage of the power transmitted to the load 42 passes directly through the series combination of the bucking winding 40 and the secondary winding 18 from the A.C. voltage source. For example, assume that the A.C. voltage source is nominally 117V and deviates to a low of 105V and a high of 129V. That is, the input voltage will deviate by 12V from the nominal value in either direction. Under the teachings of the invention, the power handling capability of the transformer power regulator 11 would be 12V multiplied by the maximum load current. If the maximum load current is 20 amperes, a power transformer regulator of 240 watts rating controls in excess of 2000 watts, i.e. a regulated 117V multiplied by 20 amperes. The number of turns on the bucking winding 40 is selected such that the bucking winding 40 drops 12V at the high input voltage level of 129V. In this situation, the net voltage reaching the load 42 is 117V without any regulation of the control windings 21, 22 and without any contribution or interaction from the secondary winding 18. However, if the input voltage is at the 105V low, the secondary winding 18 must add sufficient voltage to compensate for both the low deviation in the input voltage plus the voltage dropped by the bucking winding 40. At input voltages in between these high and low extremes, the variable reluctance in the control winding leg portions 19, 20 will control the degree of coupling between the primary and secondary windings 16, 18 to maintain an output voltage of the nominal 117V. The transformer power regulator 11 thus compensates for input line voltage variations while regulating power to a load.

Detailed test data of an existing 300 watt rated transformer in regulating as much as 2000 watts at a load is further illustrative of the advantages of the present invention:

AT A.C. VOLTAGE SOURCE = 110V

| | Control Windings | | |
|---|---|---|---|
| Load Wattage | Amperes | Volts | Watts |
| 250 | .30 | 1.44 | .42 |
| 500 | .55 | 2.40 | 1.32 |
| 750 | .80 | 3.40 | 2.72 |
| 1000 | 1.10 | 4.65 | 5.10 |
| 1250 | 1.55 | 6.55 | 10.15 |
| 1500 | 1.90 | 8.10 | 15.39 |
| 1750 | 2.70 | 11.00 | 29.70 |

-continued

AT A.C. VOLTAGE SOURCE = 115V

| Load Wattage | Control Windings Amperes | Volts | Watts |
|---|---|---|---|
| 250 | .245 | 1.22 | .30 |
| 500 | .480 | 2.15 | 1.03 |
| 750 | .70 | 3.10 | 2.17 |
| 1000 | 1.0 | 4.30 | 4.30 |
| 1250 | 1.25 | 5.40 | 6.75 |
| 1500 | 1.55 | 6.70 | 10.39 |
| 1750 | 1.90 | 8.10 | 15.39 |
| 2000 | 2.50 | 9.0 | 22.50 |

AT A.C. VOLTAGE SOURCE = 120V

| Load Wattage | Control Windings Amperes | Volts | Watts |
|---|---|---|---|
| 250 | .220 | 1.25 | .275 |
| 500 | .435 | 2.10 | .914 |
| 750 | .620 | 2.80 | 1.736 |
| 1000 | .90 | 3.80 | 3.42 |
| 1250 | 1.10 | 4.80 | 5.28 |
| 1500 | 1.40 | 6.0 | 8.40 |
| 1750 | 1.60 | 7.20 | 11.52 |
| 2000 | 2.0 | 8.20 | 16.40 |

AT A.C. VOLTAGE SOURCE = 125V

| Load Wattage | Control Windings Amperes | Volts | Watts |
|---|---|---|---|
| 250 | .17 | 1.05 | .179 |
| 500 | .38 | 1.30 | .494 |
| 750 | .55 | 2.50 | 1.375 |
| 1000 | .74 | 3.30 | 2.375 |
| 1250 | .90 | 3.75 | 3.375 |
| 1500 | 1.15 | 4.80 | 5.520 |
| 1750 | 1.42 | 5.90 | 8.375 |
| 2000 | 1.70 | 7.10 | 12.070 |

AT A.C. VOLTAGE SOURCE = 130V

| Load Wattage | Control Windings Amperes | Volts | Watts |
|---|---|---|---|
| 250 | 0.0 | 0.0 | 0.0 |
| 500 | .185 | .65 | .12 |
| 750 | .40 | 1.60 | .64 |
| 1000 | .60 | 2.50 | 1.50 |
| 1250 | .80 | 3.0 | 2.40 |
| 1500 | 1.05 | 3.8 | 3.99 |
| 1750 | 1.27 | 4.65 | 5.90 |
| 2000 | 1.50 | 5.6 | 8.40 |

AT A.C. VOLTAGE SOURCE = 135V

| Load Wattage | Control Windings Amperes | Volts | Watts |
|---|---|---|---|
| 250 | 0.0 | 0.0 | 0.0 |
| 500 | 0.0 | 0.0 | 0.0 |
| 750 | 0.0 | 0.0 | 0.0 |
| 1000 | .50 | 1.75 | .875 |
| 1250 | .70 | 2.50 | 1.75 |
| 1500 | .90 | 3.40 | 3.06 |
| 1750 | 1.20 | 4.40 | 5.28 |
| 2000 | 1.40 | 5.30 | 7.42 |

As can be seen from the above data, the transformer regulator is highly efficient. Generally, the control power required to maintain the output voltage at 117V at various load wattages is less than 1 percent. Some of the control power requirements at lower input voltages and higher load wattages which slightly exceed 1 percent tend to indicate that the core material of the transformer is magnetically saturated due to the higher current levels needed at lower input voltages to maintain constant load power. The above test data was recorded from a transformer regulator having the following characteristics:

primary winding 16 — 301 turns of No. 14 wire
bucking winding 40 — 50 turns of No. 11 wire
control winding 21, 22 — 587 turns of No. 18 wire each
secondary winding 18 — 120 turns of No. 11 wire
laminated iron core 12 — 11 lbs., 6 oz.
total transformer weight — 18 lbs., 11 oz.

From the above example and from the above test data, it can be readily seen by those skilled in the art that the degree of advantage to be gained from the invention depends upon the maximum expected deviation of the A.C. voltage source from its nominal value. If such deviation is small, a transformer power regulator 11 of low wattage rating can easily control ten times or more of its power rating in terms of load wattage. On the other hand, larger deviations in A.C. input voltage may limit the advantage in load power handling capability to several times the power rating of the transformer power regulator.

It should be further noted that contrary to most transformers which provided electrical isolation between the input and output windings, the transformer power regulator 11 of the present invention provides no such isolation.

Figure 5:
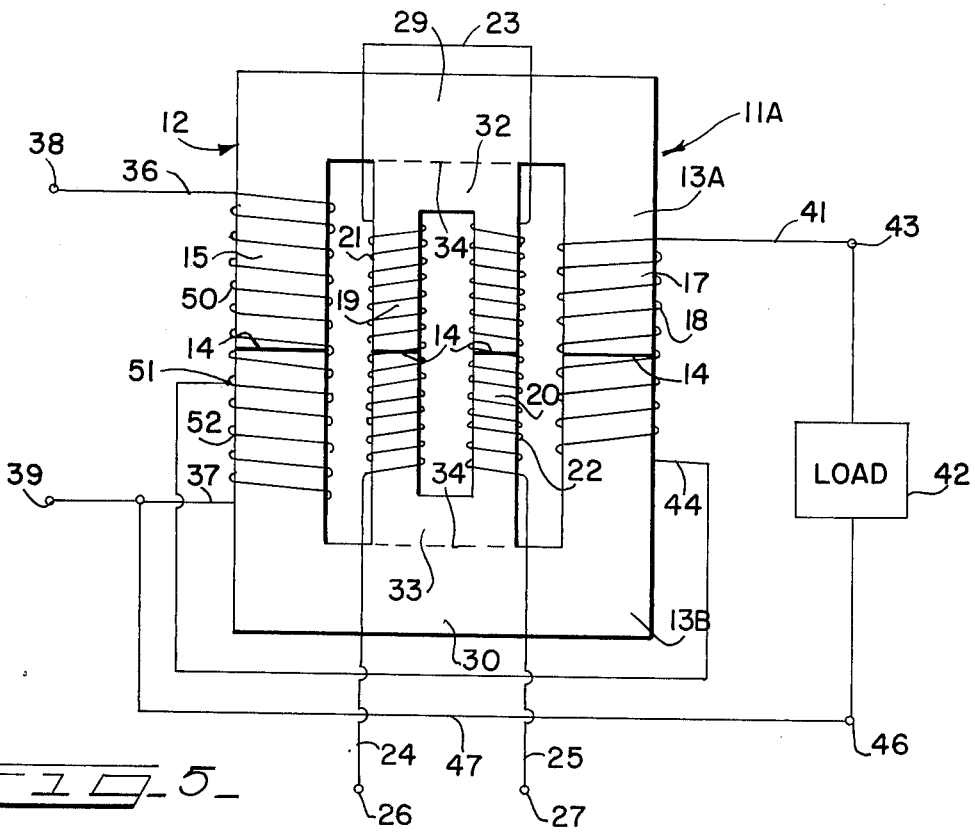
FIG. 5 is a diagrammatic plan view illustrating another embodiment of the invention wherein the bucking winding, instead of being a separate winding associated with the primary winding as in FIGS. 1 and 4, is provided by tapping a portion of the primary winding.

FIG. 5 illustrates an alternative embodiment of the invention wherein a primary winding 50 is tapped at a point 51 to provide the bucking winding 52. This is similar to an autotransformer technique. This further has the advantage that the transformer regulator 11A weighs less than the transformer regulator 11 of FIGS. 1 and 4 due to the fact that the bucking winding 52 is not a separate winding but is part of the primary winding 50. Tapping of the primary winding 50 as indicated in FIG. 5 provides the advantage that the bucking winding 52 is appropriately phased in bucking relationship to the primary winding 50.

Other benefits and advantages are derived from the transformer power regulator 11. Due to the fact that the regulator 11 regulates only a fraction of the power delivered to the load 42, the power regulator has the additional advantages that it operates at higher efficiency by generating less heat loss. Large power transformers also typically generate audible noise at the frequency of the power generating source. Since the power transformer regulator of this invention handles only a fraction of the total power delivered to the load, far less noise is generated than in typical transformers which handle the entire load power. The same is also applicable to stray magnetism generated by the regulator of the present invention as compared to transformers which must handle the entire load power. The response time of the transformer power regulator in responding to voltage variations is extremely rapid. In actual practice the response time of the transformer power regulator may be limited by the response time of the control means or circuitry used to regulate the control windings 21, 22 at the terminals 26, 27. The inductance of the primary winding 40 and the secondary winding 18 further provide electrical noise attenuation to provide a more filtered power to the load 42.

While the above disclosure has concentrated on a transformer power regulator 11 for a single-phase A.C. voltage source, it will be readily apparent that the above teachings can also be applied to multiple-phase power systems. This can be done by utilizing separate transformer power regulators 11 for each of the phases of the power system and by applying appropriately phased A.C. or D.C. signals to the control windings of the respective regulators. This can also be accomplished by utilizing a single unitary transformer core with multiple sets of windings, one set of windings for each phase to be controlled. For instance, in a three-phase power system three separate sets of window areas in a single core would each contain a set of windings for each phase.

The transformer power regulator 11 is intended to operate at the lower power transmission frequencies such as 50, 60 and 400 Hertz. As is well known in the transformer arts, the operating frequency may affect the selection of the core materials and physical dimensions of the core.

The transformer power regulator of the present invention is quite versatile and adaptable for use in many applications relating to power supply and control. The manner in which the transformer regulator functions in a particular application depends in part upon the energization state of the control windings which depends in turn upon the type of feedback or sensing controls utilized. Thus, while the disclosure has concentrated upon voltage regulation to a load, it will be readily apparent that the regulator could be utilized for current regulation as well.

It will be understood that various changes and modifications can be made without departing from the spirit of the invention as defined in the following claims, and equivalents thereof.

I claim:

1. A transformer power regulator for efficiently and variably supplying at least 50 watts of power to a load from an A.C. voltage source while simultaneously compensating for variations from a nominal potential supplied by the voltage source, said regulator comprising:

a laminated core structure defining a primary winding leg portion, a secondary winding leg portion, and a pair of control winding leg portions, all of said leg portions being in coplanar relationship;

said control winding leg portions being intermediate to said primary and said secondary winding leg portions for effectively shunting flux induced in said primary winding leg portion away from said secondary winding leg portion;

said core structure further including back portions between said primary and secondary winding leg portions thereby defining a main magnetic flux circuit that is of closed circuit configuration and is continuous and uninterrupted between said primary and secondary leg portions;

said core structure also including bridge portions between said control winding leg portions thereby defining a control magnetic flux circuit that is of closed circuit configuration and is continuous and uninterrupted between said control winding leg portions with said control magnetic flux circuit being separate from said main magnetic flux circuit;

a control winding on each of said control winding leg portions, said control windings being electrically connected in bucking relation for application thereto of equal ampere turns for energizing same between deenergized and fully energized conditions to correspondingly vary the reluctance of said control winding leg portions between minimum and maximum conditions such that said control winding leg portions variably shunt flux from said primary winding leg portion of the main magnetic flux circuit away from said secondary winding leg portion in inverse proportion to reluctance of said control winding leg portions;

a primary winding with a plurality of turns wound about said primary winding leg portion including first and second leads for connecting same to the A.C. voltage source;

a bucking winding with a plurality of turns, but with fewer turns than said primary winding, wound about said primary winding leg portion with a first lead of same connected to one of the leads of the primary winding such that said bucking winding is phased in bucking relationship to said primary winding; and a secondary winding with a plurality of turns wound about said secondary winding leg portion with a first lead connectible to a load to which power is to be supplied, and a second lead of same connected to a second lead of the bucking winding such that said secondary winding is phased in aiding relationship with respect to said primary winding whereby most of power is transmitted from the A.C. voltage source directly through the bucking and secondary windings of the transformer regulator to the load with the bucking winding dropping a portion of the input voltage thereacross to compensate for the maximum expected over-voltage conditions of the A.C. voltage source and the secondary winding supplying an additional voltage variable by the degree of energization of said control windings to supply a regulated voltage to the load independent of deviations in the A.C. voltage source from the nominal value thereof.

2. The transformer regulator as in claim 1 wherein the turns ratio of the primary winding to the bucking winding is approximately 6:1.

3. The transformer regulator as in claim 1 wherein the turns ratio of the primary winding to the secondary winding is approximately 5:2.

4. The transformer regulator as in claim 1 wherein the primary winding consists of approximately 300 turns, the bucking winding consists of approximately 50 turns and the secondary winding consists of approximately 120 turns.

5. The transformer regulator as in claim 4 wherein each control winding consists of at least 300 turns.

6. A transformer power regulator for efficiently and variably supplying at least 50 watts of power to a load from an A.C. voltage source while simultaneously compensating for variations from a nominal potential supplied by the voltage source, said regulator comprising:

a laminated core structure defining a primary winding leg portion, a secondary winding leg portion, and a pair of control winding leg portions, all of said leg portions being in coplanar relationship;

said control winding leg portions being intermediate to said primary and said secondary winding leg portions for effectively shunting flux induced in said primary winding leg portion away from said secondary winding leg portion;

said core structure further including back portions between said primary and secondary winding leg portions thereby defining a main magnetic flux circuit that is of closed circuit configuration and is continuous and uninterrupted between said primary and secondary winding leg portions;

said core structure also including bridge portions between said control winding leg portions thereby defining a control magnetic flux circuit that is of closed circuit configuration and is continuous uninterrupted between said control winding leg portions with said control magnetic flux circuit being separate from said main magnetic flux circuit;

a control winding on each of said control winding leg portions, said control windings being electrically connected in bucking relation for application thereto of equal ampere turns for energizing same between deenergized and fully energized conditions to correspondingly vary the reluctance of said control winding leg portions between minimum and maximum conditions such that said control winding leg portions variably shunt flux from said primary winding leg portion of the main magnetic flux circuit away from said secondary winding leg portion in inverse proportion to reluctance of said control winding leg portions;

a primary winding with a plurality of turns wound about said primary winding leg portion including a first and second leads for connecting same to the A.C. voltage source;

a portion of said primary winding tapped to provide a bucking winding with a plurality of turns, but with fewer turns than said primary winding, with a first lead of same connected to said A.C. voltage source, said bucking winding phased in bucking relationship to said primary winding; and a secondary winding with a plurality of turns wound about said secondary winding leg portion with a first lead connectible to a load to which power is to be supplied, and a second lead of same connected to a second lead of the bucking winding such that said secondary winding is phased in aiding relationship with respect to said primary winding whereby most of the power is transmitted from the A.C. voltage source directly through the bucking and secondary winding of the transformer regulator to the load with the bucking winding dropping a portion of the input voltage thereacross to compensate for the maximum expected over-voltage conditions of the A.C. voltage source and the secondary winding supplying an additional voltage variable by the degree of energization of said control winding to supply a regulated voltage to the load independent of deviations in the A.C. voltage source from the nominal value thereof.

7. A method for efficiently and variably supplying at least 50 watts of power to a load from an A.C. voltage source while simultaneously compensating for variation from the nominal potential supplied by the voltage source, said method comprising:

utilizing a laminated core structure defining a primary winding leg portion, a secondary winding leg portion and a pair of control winding leg portions, all of said leg portions being in coplanar relationship, said control winding leg portions being intermediate to said primary and secondary winding leg portions for effectively shunting flux induced in said primary winding leg portion away from said secondary winding leg portion, said core structure including back portions between said primary and secondary winding leg portions thereby defining a main magnetic flux circuit that is of closed circuit configuration and is continuous and uninterrupted between said primary and secondary winding leg portions, said structure also including bridging portions between said control leg portions defining a control magnetic flux circuit that is of closed circuit configuration and is continuous and uninterrupted between said control winding leg portions and is separate from said main magnetic flux circuit;

providing a control winding on each of said control winding leg portions, said control windings being electrically connected in bucking relation for application thereto of equal ampere turns for energizing same between deenergized and fully energized conditions to correspondingly vary magnetic reluctance of said control winding leg portions between minimum and maximum conditions such that said control winding leg portions variably shunt flux from said primary winding leg portion of main magnetic flux circuit away from said secondary winding leg portion in inverse proportion to the reluctance of said control winding leg portions;

providing a primary winding with a plurality of turns wound about said primary winding leg portion including first and second leads for connecting same to the A.C. voltage source;

providing a bucking winding with a plurality of turns, but with fewer turns than said primary winding, wound about said primary winding leg portion with a first lead of same referenced to said A.C. voltage source, said bucking winding phased in bucking relationship to said primary winding; and providing a secondary winding with a plurality of turns wound about said secondary winding leg portion with a first lead connectible to a load to which power is to be supplied, and a second lead with same connected to a second lead of the bucking winding such that said secondary winding is phased in aiding relationship with respect to said primary winding such that most of the power is transmitted from the A.C. voltage source directly through the bucking and secondary winding of the transformer regulator to the load with the bucking winding dropping a portion of the input voltage there-across to compensate for the maximum expected over-voltage condition of the A.C. voltage source and that the secondary winding supplying an additional voltage variable by the degree of energization of said control windings to supply a regulated voltage to the load independent of deviations in the A.C. voltage source from the nominal value thereof.

* * * * *